US007633393B2

(12) United States Patent
Bonne

(10) Patent No.: US 7,633,393 B2
(45) Date of Patent: Dec. 15, 2009

(54) SPRINKLER STATUS INDICATOR

(75) Inventor: Ulrich Bonne, Hopkins, MN (US)

(73) Assignee: Honeywell International Inc., Morristown, NJ (US)

( * ) Notice: Subject to any disclaimer, the term of this patent is extended or adjusted under 35 U.S.C. 154(b) by 250 days.

(21) Appl. No.: 11/405,290

(22) Filed: Apr. 17, 2006

(65) Prior Publication Data

US 2007/0241891 A1 Oct. 18, 2007

(51) Int. Cl.
*G08B 13/14* (2006.01)
*G08B 21/00* (2006.01)
*G08B 1/08* (2006.01)

(52) U.S. Cl. ..... 340/572.1; 340/686.1; 340/539.22; 340/577; 340/584

(58) Field of Classification Search ..... 340/572.1, 340/539.22, 686.1, 577, 584
See application file for complete search history.

(56) References Cited

U.S. PATENT DOCUMENTS 3,713,148 A 1/1973 Cardullo et al. ..... 343/6.5 R
4,357,602 A * 11/1982 Lemelson ..... 340/539.27
4,596,289 A * 6/1986 Johnson ..... 169/37
4,814,766 A * 3/1989 Domingue ..... 340/590
5,669,449 A * 9/1997 Polan et al. ..... 169/16
5,971,080 A * 10/1999 Loh et al. ..... 169/43
6,357,531 B1 * 3/2002 Asselin ..... 169/17
6,446,732 B1 * 9/2002 Polan ..... 169/37
7,081,815 B2 * 7/2006 Runyon et al. ..... 340/541
2005/0087235 A1 * 4/2005 Skorpik et al. ..... 137/554
2006/0226970 A1 * 10/2006 Saga et al. ..... 340/506
2007/0241866 A1 * 10/2007 Cool et al. ..... 340/10.41
2008/0277125 A1 * 11/2008 Wilkins et al. ..... 169/46

* cited by examiner

*Primary Examiner*—Daniel Wu
*Assistant Examiner*—John F Mortell
(74) *Attorney, Agent, or Firm*—Husch Blackwell Sanders Welsh & Katz

(57) ABSTRACT

A fire suppression valve includes an RF transmitter which transmits an indication that a closed valve has opened. The transmitter can be implemented as a passive wireless identifier tag energized by a source of wireless signals.

23 Claims, 2 Drawing Sheets

SPRINKLER STATUS INDICATOR

FIELD

The invention pertains to fire suppression systems. More particularly the invention pertains to such systems where wireless indicators are provided as to the existence of an alarm condition.

BACKGROUND

It's been recognized that automatic sprinkler systems, which respond to heat generated by a fire, can be important additions to building monitoring or fire alarm system. One of the advantages of the sprinkler systems is that they respond automatically to local heat and can be effective in suppressing fires even before any of the first responders such as fire or police arrive at the scene.

Known sprinkler systems and sprinkler heads are passive devices which respond to localized heat to melt a material, which could be a metal, which then permits the head to start spraying pressurized water from the associated distribution system. It's been recognized that this configuration has the disadvantage that the associated fire monitoring system does not receive any signals from the sprinkler heads which indicate which heads have gone active, into an alarm state, and which heads have not.

While a variety of flow sensors have been developed which can be installed in sprinkler standpipes to provide an indication of water flow, knowledge of which sprinkler head or heads have opened would require installing and powering flow sensors in pipes leading to nearly each head, which would be costly. However, it may be very important and useful to first responders to know which sprinklers have opened. In addition to limited information obtainable from flow sensors, they represent ongoing maintenance problems and expense. Further, known flow sensors are coupled to the alarm system by hard wiring.

Thus there continues to be a need for devices which cost effectively make it possible to identify specific, active, sprinkler heads. Further, it would be desirable to be able to incorporate such devices into known types of sprinkler heads, perhaps even be able to retrofit them, without requiring substantial and expensive changes to the structure of such heads.

DETAILED DESCRIPTION

Figure 1:
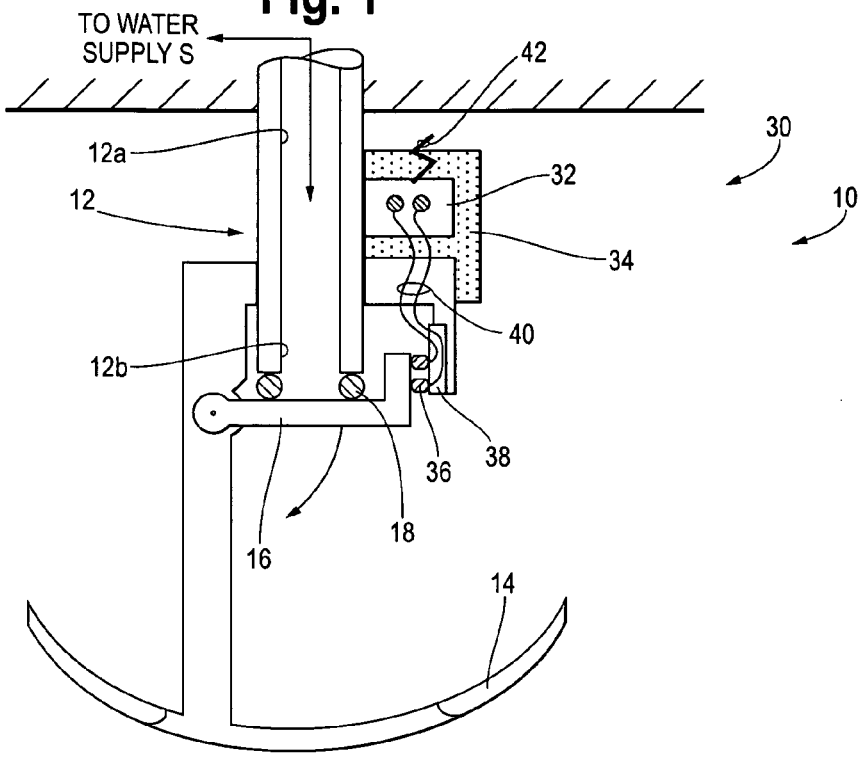
FIG. 1 is a cross-sectional view of a sprinkler head with a status transmitter in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Sprinkler heads which embody the invention communicate wirelessly with an alarm monitoring system to provide real time information that a head has gone from an inactive to active state. The active state is indicative of the head having opened, in response to local heat, for purposes of suppressing a fire.

In one aspect of the invention, the head can incorporate a wireless transmitter or a passive radio frequency identification (RFID) tag. The transmitter or tag can emit a wireless signal into an adjacent region which can in turn be sensed, via one or more receivers, by the local alarm monitoring system.

In another embodiment of the invention, a conductive fusible link can be used to establish, at the sprinkler head, that the valve cap of the head has moved from a closed to an open position. Responsive thereto, the transmitter or RFID tag can emit a wireless signage indicative of this change of state.

In another embodiment of the invention, a local wireless transmitter can be installed on the sprinkler head and coupled electrically to the respective valve cap. When the valve cap is in a closed or inactive state, the transmitter is also inactive. When the sprinkler responds to the presence of local heat and the valve cap opens for suppression of fire, the change in state can activate the transmitter which can in turn transfer a sprinkler head identifier to one or more receivers associated with the alarm system.

The transmitter could include a self contained power supply. Alternately, the transmitter could be energized by other wireless signals intentionally transmitted into the region of interest which can couple electrical energy to the transmitter on a non-contact basis.

In yet another aspect of the invention, RFID tag can be incorporated into a sprinkler. In one embodiment, the RFID tag could in part be mounted on the valve cap and in part be mounted a body portion. When the valve cap opens in response to local heat, the configuration of the RFID tag changes. When energized by incident RF energy the tag can emit an alarm indicating status indicium which is different than the indicium omitted by the tag under normal, inactive, conditions.

In yet another aspect of the invention, a plurality of sprinkler heads can be installed in a region being monitored. One or more transmitters can be provided to inject wireless, energy supplying signals into the region. Such signals can in turn energize sprinkler head mounted transmitters or RFID tags. Receivers located throughout the region can sense and forward the alarm indicating signals from the respective sprinkler heads to the associated alarm system.

FIG. 1 illustrates a sprinkler head 10 in accordance with the invention. The head 10 incorporates a housing generally indicated at 12 which could be formed as a section of pipe which has an internal flow channel 12*a*. The housing 12 is coupled, as would be understood by those of skill in the art, to a water supply S, for example, which might be supplied by a standpipe in a building or a region being monitored.

The head 10 also includes a valve cap 16 which closes outflow port 12*b* of the housing 12 in normal, non-emergency situations. A seal 18 can be located between the outflow 12*b* and the valve cap 16.

The sprinkler head 10 also incorporates a status indicating structure 30. The structure 30 is carried on the housing 12.

The structure 30 incorporates a transmitter 32 which can intermittently emit wireless, for example RF signals, indicative of the status of the sprinkler head 10. Transmitter 32 is protected from local heat, due to a fire, by thermal insulation 34.

One or more fusible links 36, preferably two, are carried on a ceramic insulator 38 adjacent to the transmitter 32. The links 36 in a normal, non-alarm state, lock the valve cap 16 in a closed position thereby preventing water flow from the outflow port 12*b*. At the presence of fire, the links 36 melt and water pressure forces cap 16 open which in turn produces a spray defined by the diverter 14.

As illustrated in FIG. 1, the links 36 are coupled electrically via conductors 40 to the transmitter 32. The transmitter can sense the presence of a normal, non-active or non-alarm state with valve cap 16 closed due to electrical or conductive path which extends through conductors 40 and the links 36. When the valve cap 16 opens due to the links 36 having melted in response to heat from a fire, the electrical path open circuits. This change of state is detectable by the transmitter 32.

The transmitter 32 can intermittently, in accordance with a predetermined protocol, transmit a status indicator indicated generally at 42 to a displaced receiver. The status indicator 42 is a substantially real-time indicator and locator of the presence of a fire and the fact that there is enough heat in the vicinity of the sprinkler head 10 to cause same to enter an active state. The exact details of the transmitter 32 are not limitations in the present invention. Transmitter 32, as would be understood by those of skill in the art, can incorporate a self contained power supply. Alternately, it can be powered from an external source via transmitted RF signals without limitation.

The transmitter 32 is protected by the insulation 34 to provide a time interval during which the transmitter 32 can continue to function even the presence of an adjacent fire. The ceramic insulator 38 in combination with the fusible links 36 are configured such that the links 36 will not short contacts on the insulator 38 when they are melted by heat from the local fire.

As those of skill in the art will understand energizing of the transmitter 32 via incident RF signals eliminates any need for local batteries which would have to tested and maintained periodically. Additionally, the lack of an internal power source for the transmitter 32 helps reduce the cost thereof.

Figure 2:
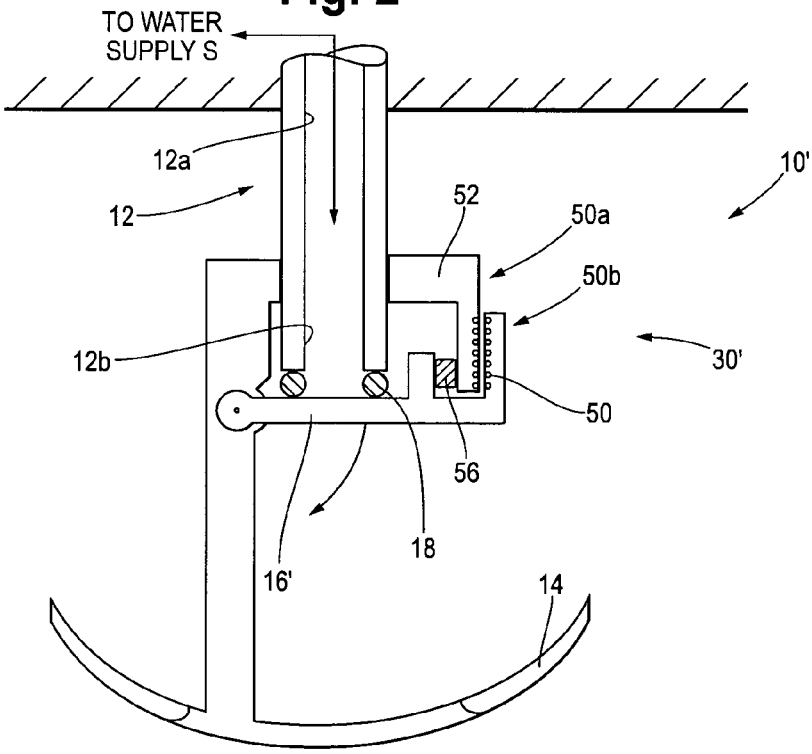
FIG. 2 is a cross-sectional view of a sprinkler head with an RF ID-type tag in accordance with the present invention.

FIG. 2 illustrates an alternate configuration 10' of a sprinkler head which incorporates a wireless RFID-type status indicator in accordance with the invention. Structural elements of the sprinkler 10' which are identical to those of the sprinkler head 10 have been assigned identical identification numerals and do not need further discussion.

The sprinkler head 10' incorporates a status indicating apparatus 30' which is carried on the housing or pipe 12. A valve cap 16', which normally closes the out flow 12*b* of the sprinkler head 10' forms a portion of RFID-type tag 50. The advantages of RDID-type tags have been recognized. Their structure and operation would be known to those of skill in the art. One early form thereof was previously disclosed in U.S. Pat. No. 3,713,148 entitled Transponder Apparatus and System.

In accordance with the present invention, the RFID-type tag 50 has a fixed portion indicated generally at 50*a* which is carried on member 52 and attached to housing 12. A second portion 50*b* of the RFID-type tag 50 is carried on the valve cap 16'. Fusible link 56 which could be a metal, plastic or the like all without limitation locks the valve cap 16' into a closed, non-active or non-alarm state such that the members 50*a*, 50*b* are adjacent to one another. If desired, the members 50*a*, 50*b* could be in fact be in electrical contact with one another.

In the presence of local heat due to a fire, the link 56 will soften and melt and the valve cap l6' will be opened due to water pressure from supply S in housing 12. As a result, water will flow from out flow port 12*b* to suppress the fire. At the same time, the portions 50*a*, 50*b* of the RF ID-type tag 50 will separate for one another thereby providing a different, alarm indicating configuration thereof. Once the parts 50*a*, 50*b* separate when the RFID tag 50 is energized by an exterior source of RF signals, it can emit an active or alarm indicating indicium wirelessly to one or more local receivers.

In a normal inactive state the RFID-type tag 50 can respond to energizing wireless signals as would be understood by those of skill in the art to emit to inactive, non-alarm indicium. Such an indicium can be sensed by one or more receivers in the region and forwarded to the local monitoring system.

The configuration 30' is particularly advantageous in that it is a very low cost passive indicator of the status of the link 36 and hence the sprinkler head 10'. Further, it is expected that unit 30' could be configured to withstand temperatures from fire which would soften and melt the link 36.

Figure 3:
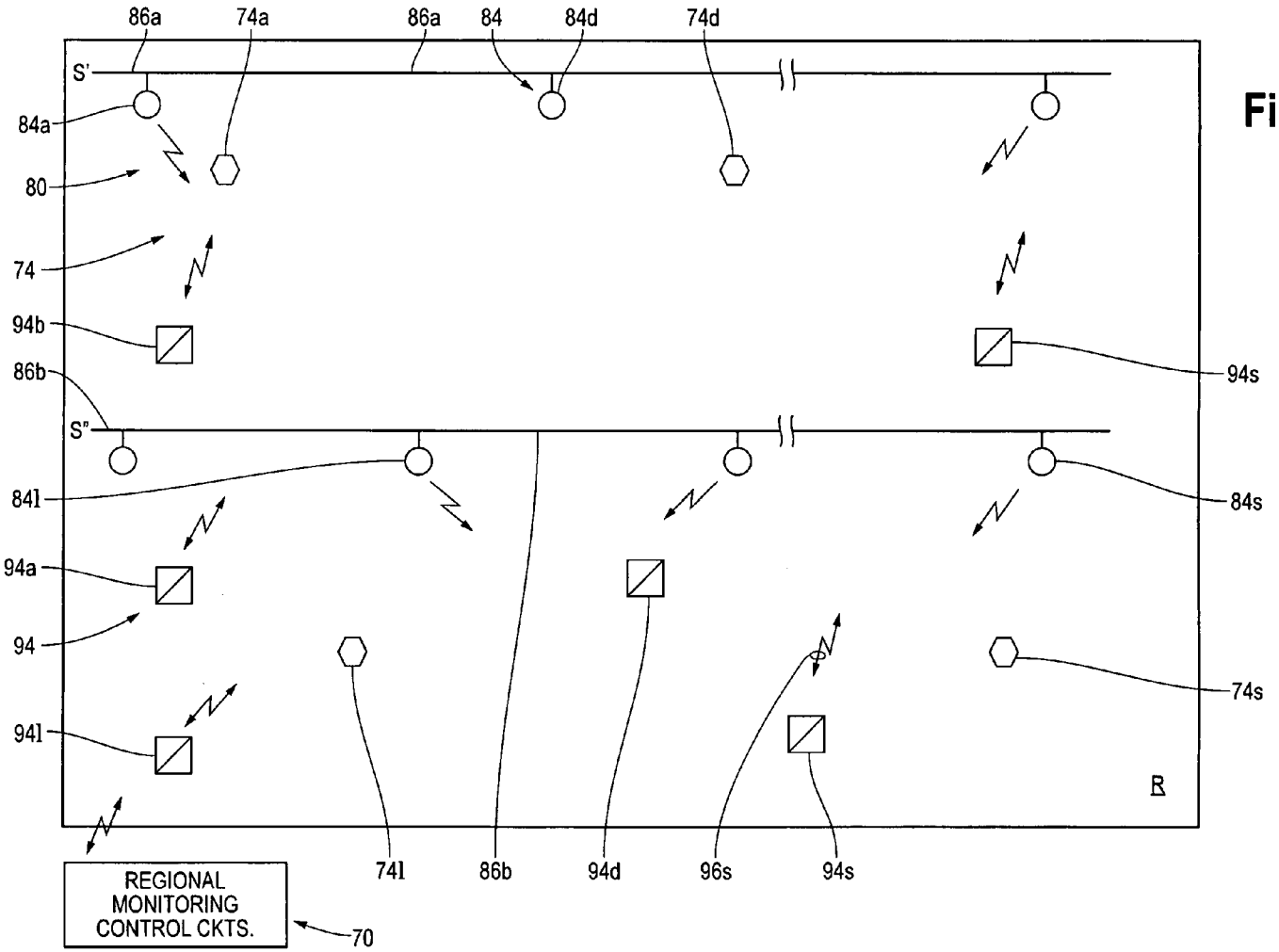
FIG. 3 is a top plan view of region being monitored by a monitoring system in accordance with the invention.

FIG. 3 illustrates a region R which is to be monitored. Monitoring is implemented via an ambient or building control/monitoring system which incorporates a control unit or control circuits indicated generally at 70. A plurality of ambient condition detectors 74 having members 74*a* . . . 74*d* . . . 74*l* and 74*s* are in wired or wireless communication with the control circuits 70. The members of a plurality 74 could include smoke detectors, flame detectors, gas detectors, thermal detectors and the like all without limitation.

A fire suppression system 80 is also incorporated into the region R. The suppression system 80 incorporates a plurality 84 of sprinkler heads such as 84*a* . . . 84*d* . . . 84*l* and 84*s*. The members of the plurality 84 are each coupled to sources S', S" of water or suppression fluids indicated generally at 86*a*, 86*b*.

The members of the plurality 84 could be implemented as sprinkler heads 10 or 10' as discussed previously. A plurality of transceivers 90 having members 94*a*. . . 94*d*. . . 941. . . 94*s* are distributed throughout the region R. The members of the plurality 94 transmit and receive RF signals, indicated generally at 96*s*, of a type which can energize as well as receive a wireless indicia from the members of the plurality 84. It will be understood that the members of the plurality 94 are in wired or wireless communication with the control circuits 70. The transceivers 94 couple sprinkler status indicia received wirelessly from the members of the plurality 84 to the monitoring and control circuits 70 for evaluation and for purposes of establishing alarm conditions as would be understood by those of skill in the art.

It will also be understood that the transceivers 94 could be incorporated into some or all of the ambient condition detectors 74 all without limitation. Alternately, the transceivers could be implemented as separate receivers and transmitters all without limitation.

In accordance with the present invention, the control circuits 70 are able to determine where in the region R a sprinkler head has gone from an inactive to an active state substantially in real time for purposes of identifying the location of an alarm condition. Such information can be forwarded to first responders and also provided to individuals in the region R to assist them in making a safe departure therefrom.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An apparatus comprising:

a valve with an internal flow channel; the valve having an open and a closed state and a multi-position valve cap that is hingedly connected to the valve, the cap rotates about a connection point between a closed position in which the flow channel is closed and an open position in which the flow channel is open, the cap remaining affixed to the apparatus throughout its entire range of motion between the closed position and the open position;

a heat responsive element directly coupled to the cap which in the absence of a predetermined amount of applied heat, retains the valve in the closed state; and a device, directly coupled to the element which is directly responsive to a change in the valve's state and emits a wireless signal indicative of the valve's changed state.

2. An apparatus as in claim 1 where the device comprises a passive radio frequency identifier-type tag.

3. An apparatus as in claim 2 where the identifier is responsive to the state of the element.

4. An apparatus as in claim 3 where the element has a continuous state and a discontinuous state.

5. An apparatus as in claim 1 where the element separates into two portions in response to the applied heat.

6. An apparatus as in claim 1 where the element comprises a conductive material.

7. An apparatus comprising:

a valve that has an open and a closed state and a multi-position valve cap that is hingedly connected to the valve, the cap remaining affixed to the apparatus throughout its entire range of motion between the open state and the closed state;

a heat responsive element directly coupled to the valve cap which in the absence of a predetermined amount of applied heat, retains the valve in the closed state, a device, directly coupled to the element, which emits a wireless signal indicative of the valve's changed state; the device being responsive to radio frequency energy received wirelessly.

8. An apparatus as in claim 7 where the device, responsive to received energy, and responsive to a state of the element, emits a predetermined wireless signal.

9. An apparatus as in claim 1 where the device, responsive to received energy, and responsive to a state of the element, emits a predetermined wireless signal.

10. An apparatus as in claim 1 where the device includes a wireless transmitter.

11. A system comprising:

a plurality of fire suppression valves, each of the valves includes a multi-position valve cap that rotates about a connection point and remains affixed throughout its entire range of motion and a wireless state indicating emitter mechanically coupled between the valve and the cap that directly detects a change in state of the valve;

at least one wireless receiver; and at least one radio frequency transmitter, energy from the transmitter activates the emitters.

12. A system as in claim 11 which includes a control element coupled to the receiver.

13. A system comprising:

at least one radio frequency receiver; and a plurality of fire suppression valves, each of the valves having a closed state and a flow state and a passive radio frequency state indicating emitter, in response to radio frequency energy, the respective emitter wirelessly transmits a valve state indicator to the receiver;

each of the plurality of valves having a multi-position valve cap that is hingedly connected to the valve, the cap remaining affixed to the valve throughout its entire range of motion between the closed state and the flow state and wherein each of the emitters is directly coupled through a fusible link to a respective cap.

14. A system as in claim 13 which includes at least one wireless radio frequency transmitter; energy from the transmitter activates the emitters.

15. A system as in clam 14 which includes a control element coupled to the receiver and to the at least one transmitter.

16. A system as in claim 15 where the control unit intermittently activates the at least one transmitter.

17. A sprinkler head comprising:

a housing with an internal flow channel;

a multi-position valve cap for closing the channel, the valve cap hingedly connected to a member adjacent the housing such that the cap is capable of swinging between a first position in which the flow channel is sealed and a second position in which the flow channel is unobstructed, the cap remaining affixed to the member in any position relative the housing and throughout its entire range of motion between the first position and the second position;

a radio frequency emitter;

a fusible link between the valve cap and radio frequency emitter, where the fusible link retains the valve cap in the first position, where the emitter is directly coupled electrically to the cap via operation of the fusible link when the cap is in the first position and not coupled thereto when the cap is in a second position.

18. A sprinkler head as in clam 17 where the cap is retained in the first position by a heat sensitive member.

19. A sprinkler head as in claim 18 where the emitter, when energized, emits a status signal indicating that the cap is not in the first position.

20. A sprinkler head as in claim 17 where the emitter is energized by one of, incident wireless signals or a local power supply and emits an indication when the cap moves from the first position toward the second position.

21. A sprinkler head comprising: a housing with an internal flow channel; a multi-position valve cap for closing the channel, the valve cap hingedly connected to a member adjacent the housing such that the cap is capable of swinging between a first position in which the flow channel is sealed and a second position in which the flow channel is unobstructed, the cap remaining affixed to the member in any position relative the housing and throughout its entire range of motion between the first position and the second position; and a passive radio frequency identifier-type tag, a portion of which is mechanically coupled to the cap and a portion of which is mechanically coupled to the housing, which emits a wireless signal indicative of the valve cap's position.

22. A sprinkler head as in claim 21 where the identifier emits a first indicium when the cap is in the first position and a second different indicium when the cap is in a second position in response to received radio frequency energy.

23. A sprinkler head as in claim 22 where the first indicium is associated with an inactive state and the second indicium is associated with an alarm state.

* * * * *